US005400044A

United States Patent [19]

Thomas

[11] Patent Number: 5,400,044

[45] Date of Patent: Mar. 21, 1995

[54] METHOD AND APPARATUS FOR PRODUCING GREY LEVELS ON A RASTER SCAN VIDEO DISPLAY DEVICE

[75] Inventor: Alasdair R. P. Thomas, Cambridge, England

[73] Assignee: Acorn Computers Limited, Cambridge, England

[21] Appl. No.: 167,123

[22] Filed: Dec. 16, 1993

Related U.S. Application Data

[63] Continuation of Ser. No. 721,882, Jun. 27, 1991, abandoned.

[30] Foreign Application Priority Data

Jun. 29, 1990 [GB] United Kingdom ..... 9014517

[51] Int. Cl.[6] ..... G09G 3/36

[52] U.S. Cl. ..... 345/147; 345/89

[58] Field of Search ..... 340/703, 784, 793, 767; 358/456, 458; 345/89, 147, 149, 88, 148

[56] References Cited

U.S. PATENT DOCUMENTS 4,688,031 8/1987 Haggerty ..... 340/730
4,698,691 10/1987 Suzuki et al. ..... 358/458 X
4,827,255 5/1989 Ishii ..... 340/703 X
4,972,500 11/1990 Ishii et al. ..... 358/458 X

FOREIGN PATENT DOCUMENTS 384403A 8/1990 European Pat. Off. ..... 340/784
2164776 3/1986 United Kingdom .

*Primary Examiner*—Ulysses Weldon
*Assistant Examiner*—Kara A. Farnandez
*Attorney, Agent, or Firm*—Longacre & White

[57] ABSTRACT

A signal generator generates a plurality of grey level signals which are inputted into a one bit-per-pixel raster scan video display device (such as a simple matrix liquid crystal display). Each grey level signal causes a particular proportion of pixels to be illuminated, in order to produce a particular grey level. Uniform high quality grey levels are produced by introducing into each grey level signal a variable frame phase shift for successive rows of each frame. The specific phase shifts introduced between successive rows and frames result in the illuminated pixels being distributed evenly in each frame. The pattern of illuminated pixels changes smoothly with time to produce the required uniform high quality grey level.

12 Claims, 3 Drawing Sheets

METHOD AND APPARATUS FOR PRODUCING GREY LEVELS ON A RASTER SCAN VIDEO DISPLAY DEVICE

This is a continuation of application Ser. No. 07/721,882, filed Jun. 27, 1991, which was abandoned upon the filing hereof.

BACKGROUND OF THE INVENTION

The present invention relates to a method and apparatus for driving a raster scan video display device to display a plurality of grey levels. The invention is suitable for driving one bit-per-pixel devices in which the displays comprise a plurality of rows each consisting of a plurality of pixels. For example, the invention is particularly suitable for use in driving simple matrix liquid crystal displays.

Currently available simple matrix liquid crystal displays exhibit a high level of contrast between the bright and dark areas of the display. The high contrast ratio makes these displays suitable for supporting a number of grey levels, i.e. levels of brightness intermediate the brightness of a pixel when it is continuously illuminated and when it is not illuminated. These displays are designed with a standard control interface which enables each pixel in the display to be turned "on" i.e. illuminated, or "off" i.e. not illuminated, independently in every frame. Since the displays are inherently one bit-per-pixel devices, each pixel of the display may only be specified as either on or off in any one frame, and it is not possible to set the individual pixels to any intermediate grey levels. However, the liquid crystal material is slow to respond to changes in state (from on to off and vice versa). This property allows grey levels to be displayed by turning the pixels on and off in successive frames, the slow response of the liquid crystal material enabling the eye effectively to average the rapid state changes of the pixels so that the overall appearance of the display is that of a grey level. The perceived grey level of an area of the screen is dependent upon the proportion of pixels illuminated in that area in successive frames, although the quality of the grey level produced depends greatly upon the way the pattern of illuminated pixels changes with time.

A technique for generating grey levels on simple matrix liquid crystal displays is known in which complete rows of pixels are illuminated in each frame, and the rows which are illuminated are varied between successive frames. Grey levels of approximately $\frac{1}{2}$, $\frac{1}{3}$, 1/5, and $\frac{1}{8}$ are achieved by lighting one row of pixels in every 2, 3, 5, and 8 rows respectively. In each case, the illuminated rows are varied between frames to avoid a completely static display. This technique, where complete rows of pixels are illuminated, gives rise to "striping effects" in the perceived grey level where bands of bright and dark appear to progress across the screen. This problem becomes more acute as the distance between illuminated rows in each frame increases. In addition, there is poor resolution for the grey levels around 50% full brightness.

A further example of a known method of producing grey levels on a liquid crystal display is provided in GB 2164776A (Canon). This discloses a driving system for a liquid crystal display panel in which the duration of the "on" or "off" state of each pixel in each frame is controlled in order to produce a graduated display.

SUMMARY OF THE INVENTION

The present invention employs a frame rate modulation technique to synthesise a plurality of high quality grey levels.

According to the present invention there is provided apparatus for driving a one bit-per-pixel raster scan video display device, having a display which comprises a plurality of rows each consisting of a plurality of pixels, to display a plurality of grey levels, which apparatus comprises means for generating an input signal for the display device to illuminate selected pixels thereby to indicate the desired grey level, the said means including: means for generating a plurality of repetitive grey level signals, each grey level signal being indicative of a selected proportion of pixels to be illuminated to display the corresponding grey level; selector means for selectively applying a said grey level signal as the input signal to the display device in dependence upon the desired grey level of the region of the display addressed; and signal adjustment means adapted to introduce a phase shift in each grey level signal, in response to an indication that a new row is to be addressed by the input signal, to cause illumination in successive rows of each frame of a different corresponding plurality of pixels for the same desired grey level, and adapted to introduce a phase shift in each grey level signal, in response to an indication that a new frame is to be addressed, to cause illumination in successive frames of a different corresponding plurality of pixels for the same desired grey level.

The invention also provides a method of driving a one bit-per-pixel raster scan video display device having a display comprising a plurality of rows, each consisting of a plurality of pixels, to display a plurality of grey levels, which method comprises, generating an input signal for the display device to illuminate selected pixels thereby to indicate the desired grey level; generating a plurality of repetitive grey level signals, each grey level signal being indicative of a selected proportion of pixels to be illuminated to display the corresponding grey level; selectively applying a said grey level signal as the input signal to the display device in dependence upon the desired grey level of the region of the display addressed; introducing a phase shift in each grey level signal, in response to an indication that a new row is to be addressed by the input signal, to cause illumination in successive rows of each frame of a different corresponding plurality of pixels for the same desired grey level, and introducing a phase shift in each grey level signal, in response to an indication that a new frame is to be addressed, to cause illumination in successive frames of a different corresponding plurality of pixels for the same desired grey level.

The apparatus may comprise one or more grey level generators, connected to the selector means, for producing the grey level signals. Each grey level generator may be adapted to produce one or more grey level signals, so the number of grey level generators utilised will depend on the number of desired grey levels.

Each grey level signal is a repetitive binary signal, n bits in length, where n need not be the same for each grey level signal. A different bit pattern is chosen to correspond to each desired grey level. For example, in a scheme with 15 grey levels, grey level "1" may be represented by a bit pattern corresponding to 1 lit pixel in 9, level "2" by 1 lit pixel in 5, level "5" by 2 lit pixels in 5, etc.

The input signal to the display device is thus a binary signal, each bit being indicative of whether a corresponding pixel should be illuminated or not. The input data is clocked sequentially into each row of the video display device, the selector means switching between the grey level signals on a pixel-by-pixel basis to build up the desired pattern on the display.

Since, for each grey level, a phase shift is introduced between the pattern of illuminated pixels in successive rows of each frame, there is a more uniform distribution of lit pixels in each frame, so that the striping effects previously mentioned, and also "flickering effects" (where large areas of the display appear to flicker at a perceivable frequency) are inhibited.

The signal adjustment means may be adapted to introduce a phase shift in each grey level signal by controlling the number of clock pulses generated for each row and frame in such a manner that, for each grey level, the phase of the pattern of illuminated pixels is always correct at the start of every new row and every new frame. In a preferred embodiment, however, the said means for generating a plurality of grey levels comprises at least one column phase accumulator, and the signal adjustment means comprises at least one row phase accumulator, responsive to an indication that a new row is to be addressed, and at least one frame phase accumulator, responsive to an indication that a new frame is to be addressed. The column phase accumulator produces a binary output which changes in a cyclical fashion between a number of binary values. The accumulator is incremented by the clock pulses which clock the input signal into the display. This accumulator thus produces a repetitive output signal in which one or more grey level signals may be encoded. When a signal indicating the start of a new row or frame is received, the input to this accumulator is loaded from the row phase accumulator. The row phase accumulator forces the output of the column phase accumulator to a different point in the cyclical output, thereby introducing appropriate phase shifts. The row phase accumulator is loaded from the frame phase accumulator before each new frame begins to ensure that the output of the column phase accumulator is correct for the start of each new frame.

As previously stated, one or more grey level signals may be encoded in an output from the or each column phase accumulator. For example, each grey level signal may be obtained by performing appropriate logic functions on the output of the column phase accumulator. Thus, the said means for generating a plurality of grey level signals may further comprise a decoder associated with the said at least one column phase accumulator for decoding the output from that column phase accumulator to produce a desired grey level signal.

In addition, the said at least one column phase accumulator, or the associated decoder where provided, may have at least a pair of outputs, one output of the pair being an inverting output for inverting a signal on the other output of the pair. For example, inverting a grey level signal having a bit pattern corresponding to 1 lit in 5 produces a grey level signal having a bit pattern corresponding to 4 lit pixels in 5.

To achieve high quality grey levels, the phase relationship between the pattern of illuminated pixels in the said successive rows for each grey level should be such that, for each grey level, there is a regular distribution of illuminated pixels in each frame, and such, that, for each grey level, the pattern of illuminated pixels changes smoothly with time. It is desirable, therefore, to illuminate, for each grey level, a different corresponding plurality of pixels in immediately successive rows of each frame and in corresponding rows of immediately successive frames. Accordingly, it is preferred that the method includes introducing a phase shift in each grey level signal in response to an indication that a new row is to be addressed to cause illumination in immediately successive rows of each frame of a different corresponding plurality of pixels for the same desired grey level, and introducing a phase shift in each grey level signal in response to an indication that a new frame is to be addressed to cause illumination in corresponding rows of immediately successive or alternate frames of a different corresponding plurality of pixels for the same desired grey level.

Where a different corresponding plurality of pixels is illuminated in immediately successive frames, it is preferred that the method includes introducing a phase shift, in response to an indication that a new row is to be addressed, to cause, for each grey level, the pattern of illuminated pixels to be shifted by a first predetermined amount between immediately successive rows of each frame, and a introducing phase shift, in response to an indication that a new frame is to be addressed, to cause, for each grey level, the pattern of illuminated pixels to be shifted by a second predetermined amount, or by alternate second and third predetermined amounts, between corresponding rows of immediately successive frames. Whether the pattern of illuminated pixels between corresponding rows of immediately successive frames is shifted by a second predetermined amount, or by alternate second and third predetermined amounts, will depend on the number of bits in each repetition of a particular grey level signal and the number of pixels by which the pattern must be shifted between corresponding rows of successive frames for the corresponding grey level in order to achieve a high quality display as will be discussed hereinafter.

As previously discussed, each repetition of each grey level signal may be indicative of whether each pixel of a series of n adjacent pixels in a row of the display should be illuminated when that row is displayed, where n is dependent on the corresponding desired grey level. In this case, the phase shifts are preferably such that, when each grey level signal is applied as the input signal addressing a region of the display over n frames, each pixel in the said region is illuminated in at least one of the n frames. Of course, each grey level signal may equivalently be indicative of whether each pixel in a series of n adjacent pixels in a column of the display should be illuminated in each frame (although the repetition length of the grey level signal will not then necessarily be n), and the following should be construed accordingly.

High quality grey levels are then achieved when, in response to an indication that a new row is to be addressed, a phase shift is introduced into each grey level signal to cause the pattern of illuminated pixels to be shifted by an amount "f" for that grey level between corresponding rows of immediately successive frames, where f is an integer which is co-prime with n and as close as possible to n/2. (Two numbers are co-prime if they share no factors greater than 1). This ensures that, for each grey level, all pixels in the pattern are lit at least once in every n frames and that the distance between lit pixels in successive frames is maximized.

Where n is an odd number for at least one grey level signal the method preferably includes introducing a phase shift in the said at least one grey level signal in response to an indication that a new frame is to be addressed to cause the pattern of illuminated pixels to be shifted by $(n+1)/2$ or $(n-1)/2$ between corresponding rows of immediately successive frames. This results in the distance between illuminated pixels in consecutive frames being maximised and further ensures that "striping effects", where bright stripes appear to progress across the display as the pattern of illuminated pixels changes between frames, are inhibited. Thus, a high quality, uniform grey level is achieved.

Where $n=5$ for the said at least one grey level signal, it is preferred that the said first predetermined amount by which the pattern of illuminated pixels is shifted between immediately successive rows of each frame is 1 pixel. A high quality grey level of approximately one fifth full brightness is achieved in this case where only one pixel of each said series of 5 pixels is illuminated. A high quality grey level of approximately two fifths full brightness is obtained where only two adjacent pixels of each said series of 5 pixels are illuminated.

Where $n=9$ for the said at least one grey level signal, it is preferred that the said first predetermined amount by which the pattern of illuminated pixels is shifted between immediately successive rows of each frame is 2 pixels. A high quality grey level of approximately one ninth full brightness is then obtained when only one pixel of each said series of 9 pixels is illuminated. A high quality grey level of approximately one third full brightness is obtained where the first, fourth and seventh pixels of each said series of 9 pixels are illuminated. Similarly, a high quality grey level of approximately four ninths full brightness is achieved where four adjacent pixels of each said series of 9 pixels are illuminated.

Where $n=15$ for the said at least one grey level signal, it is preferred that the said first predetermined amount by which the pattern of illuminated pixels is shifted between immediately successive rows of each frame is 3 pixels. A high quality grey level of approximately four fifteenths full brightness is then obtained where only the first, third, fifth and seventh pixels in each said series of 15 pixels are illuminated.

Where n is even, there may not be a suitable value of f which is both co-prime with n and satisfactory close to n/2. For example, where n is 6, $f=1$ and $f=5$ satisfy the co-prime requirement but both these values are further from $n/2$ than is desirable for achieving a high quality grey level. In this case it is preferable to use an alternating phase shift between frames. Thus, where n is an even number greater than 2 for at least one grey level signal, the method preferably includes introducing a phase shift in the said at least one grey level :signal in response to an indication that a new frame is to be addressed to cause the pattern of illuminated pixels between corresponding rows of immediately successive frames to be shifted by alternately $n/2$ and $(n+2)/2$, or by alternately $n/2$ and $(n-2)/2$. (If the pattern were simply shifted by $n/2$ between immediately successive frames, then some pixels may never be illuminated for that grey level.)

In the case where $n=2$ for one of the grey level signals, so that 50% of the pixels are illuminated in any frame for that grey level, then each repetition of the corresponding grey level signal is indicative of whether each of two adjacent pixels in a row of the display should be illuminated when that row is displayed. In this case, the method preferably includes, in response to an indication that a new row is to be addressed, introducing a phase shift in the corresponding grey level signal to cause the pattern of illuminated pixels in immediately successive rows of each frame of the display to be shifted by one pixel, and, in response to an indication that a new frame is to be addressed, introducing a phase shift in that grey level signal to cause the pattern of illuminated pixels between corresponding rows of alternate frames to be shifted by one pixel. Shifting the pattern of illuminated pixels in this manner for this particular grey level ensures that application of a single polarity drive voltage across the pixels, which would result in electrolysis of the liquid crystal, is avoided.

INTRODUCTION OF THE DRAWINGS

A preferred embodiment of the invention will now be described, by way of example, with reference to the accompanying drawings in which.

DETAILED DESCRIPTION OF PREFERRED EMBODIMENT

Figure 1:
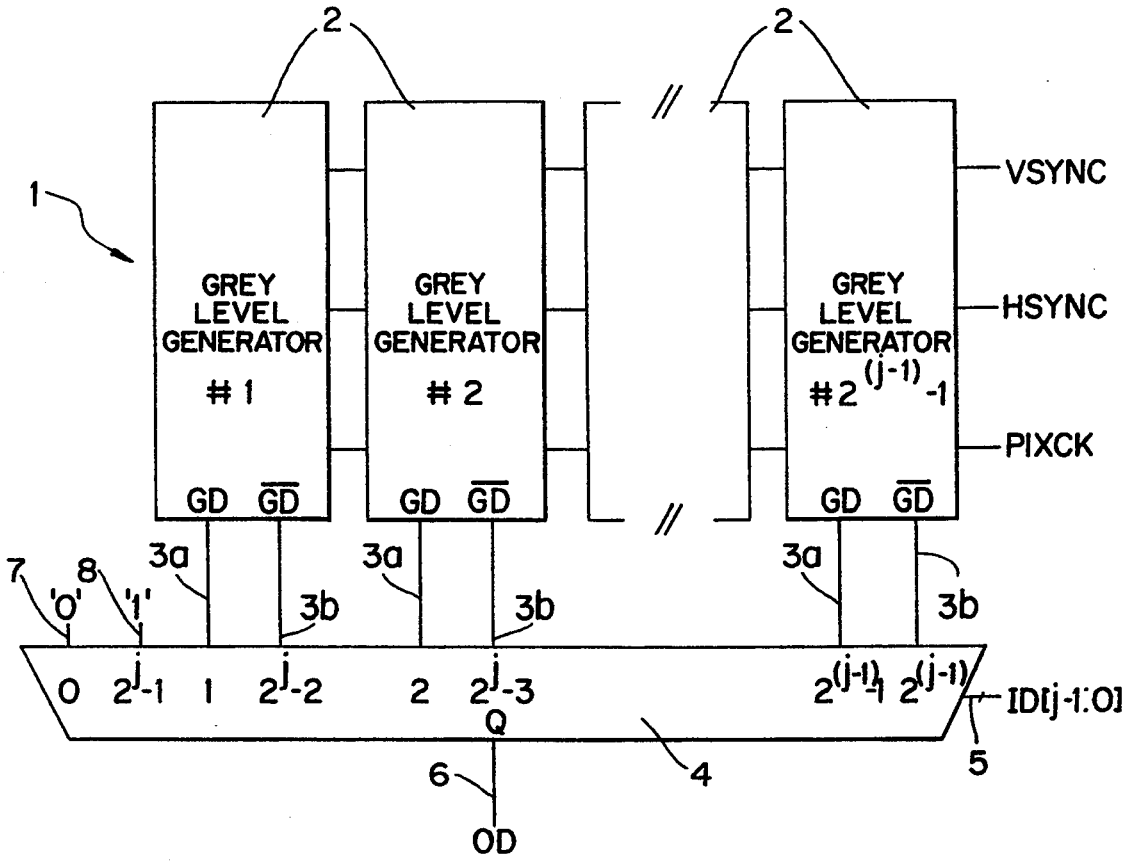
FIG. 1 is a block diagram of apparatus for driving a simple matrix liquid crystal display to display a plurality of grey levels in accordance with the invention.

FIG. 1 shows means, indicated generally at 1 for generating an input signal to a simple matrix liquid crystal display (not shown). The apparatus comprises a plurality of grey level generators 2 each having a pair of outputs 3*a*, 3*b*. Each grey level generator 2 generates one or more grey level signals, which grey level signals may be output on the output 3*a* of the corresponding grey level generator. The output 3*b* of each grey level generator is an inverting output which inverts the grey level signal on the associated output 3*a*.

The apparatus further comprises selector means in the form of a selector 4 connected to the outputs 3*a*, 3*b* of the grey level generators 2, and having an input 5 and an output 6. The selector 4 selectively connects an output 3*a* or 3*b* of a grey level generator 2 to the output 6 which is connected, in use, to the input of the liquid crystal display, thereby selectively applying a grey level signal as the input signal to the display. The selector 4 has two further inputs 7 and 8 which may also be selectively connected to the output 6. The input 7 is fed a constant LOW logic level and represents 0% pixel brightness. When the input 7 is connected to the output 6 in use, none of the pixels addressed on the display will be illuminated. The output 8 is fed a constant HIGH logic level representing 100% pixel brightness. When the input 7 is connected to the output 6 in use, all pixels addressed on the display will be illuminated.

The selector 4 selects a particular grey level signal on a pixel-by-pixel basis in dependence upon the required pixel brightness data encoded in the j bits of input data ID[j-1:0] applied at the input 5 to the selector 4, and outputs a single bit of output data OD which constitutes the input signal to the liquid crystal display in use.

The grey level generators 2 are adapted so that, collectively, they generate a plurality of grey level signals corresponding to a range of desired grey levels intermediate, for example, 0% pixel brightness and 50% pixel brightness. These grey level signals are then inverted by the inverting outputs 3*b* of the grey level generators to produce a corresponding plurality of grey level signals representative of a range of grey levels intermediate 50% pixel brightness and 100% pixel brightness.

Figure 2:
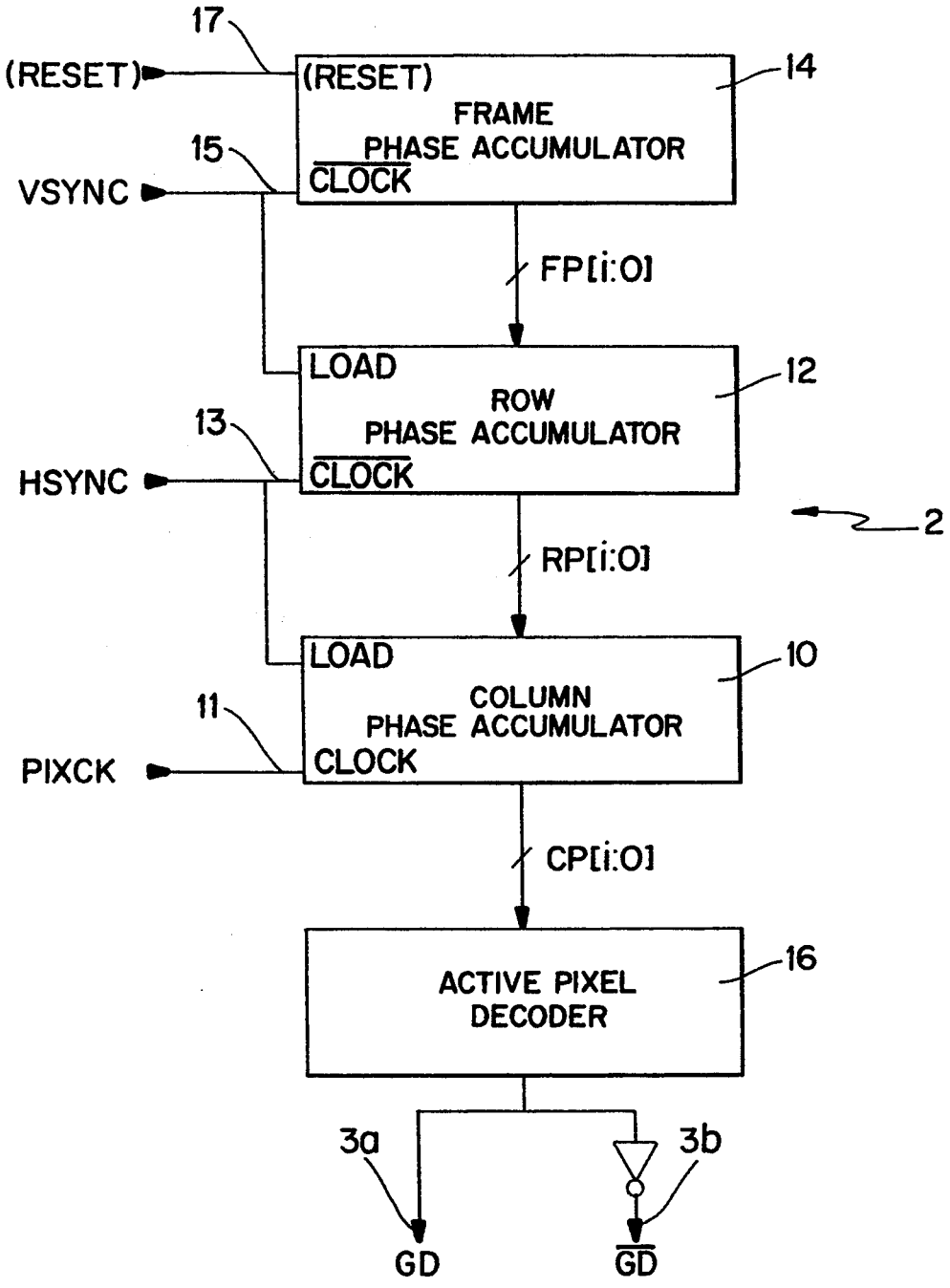
FIG. 2 is a block diagram of a grey level generator of FIG. 1.

A block diagram of a grey level generator 2 is shown in FIG. 2. The grey level generator 2 comprises a column phase accumulator 10 which generates an output CP[i:0] encoding one or more grey level signals each indicative of a selected proportion of pixels to be illuminated to display the corresponding grey level. The output CP[i:0] of the column phase accumulator is fed to a decoder 16 which decodes CP[i:0] and outputs a single grey level signal GD in dependence upon the desired grey level to be displayed. GD appears on the output 3*a* of the grey level generator 2. The grey level signal on the output 3*b* will be NOT(GD).

The column phase accumulator 10 has an input 11 for the clock signal PIXCK which clocks the output data OD from the selector 4 sequentially into each row of the liquid crystal display. CP[i:0] is incremented by one step each time PIXCK goes HIGH.

The grey level generator 2 also comprises signal adjustment means in the form of a row phase accumulator 12 and a frame phase accumulator 14.

The row phase accumulator 12 is responsive to an indication that a new row of the display is to be addressed as indicated by the HSYNC signal at an input 13 to the row phase accumulator 12. The row phase accumulator 12 introduces a phase shift in the grey level signal or signals to cause, for each grey level, the pattern of illuminated pixels to be shifted by a first predetermined amount, the "row step", between immediately successive rows of each frame. The output RP[i:0] of the row phase accumulator 12 thus determines the phase of the pattern of illuminated pixels at the start of each new row.

The frame phase accumulator 14 is responsive to an indication that a new frame of the display is to be addressed as indicated by the VSYNC signal at an input 15 to the frame phase accumulator 14. The frame phase accumulator introduces a phase shift in the grey level signal or signals to cause, for each grey level, the pattern of illuminated pixels in successive frames of the display to be shifted by an amount or amounts hereinafter referred to as the "frame step" or "f". The output FP[i:0] of the frame phase accumulator 14 thus determines the phase of the pattern of illuminated pixels at the start of each new frame.

The frame phase accumulator 14 may be provided with a RESET input 17 to set the frame phase accumulator 14 to a known state at commencement. Alternatively, the frame phase accumulator 14 may be designed to recognise any undesired states at commencement and automatically reset itself to a valid state.

Figure 3:
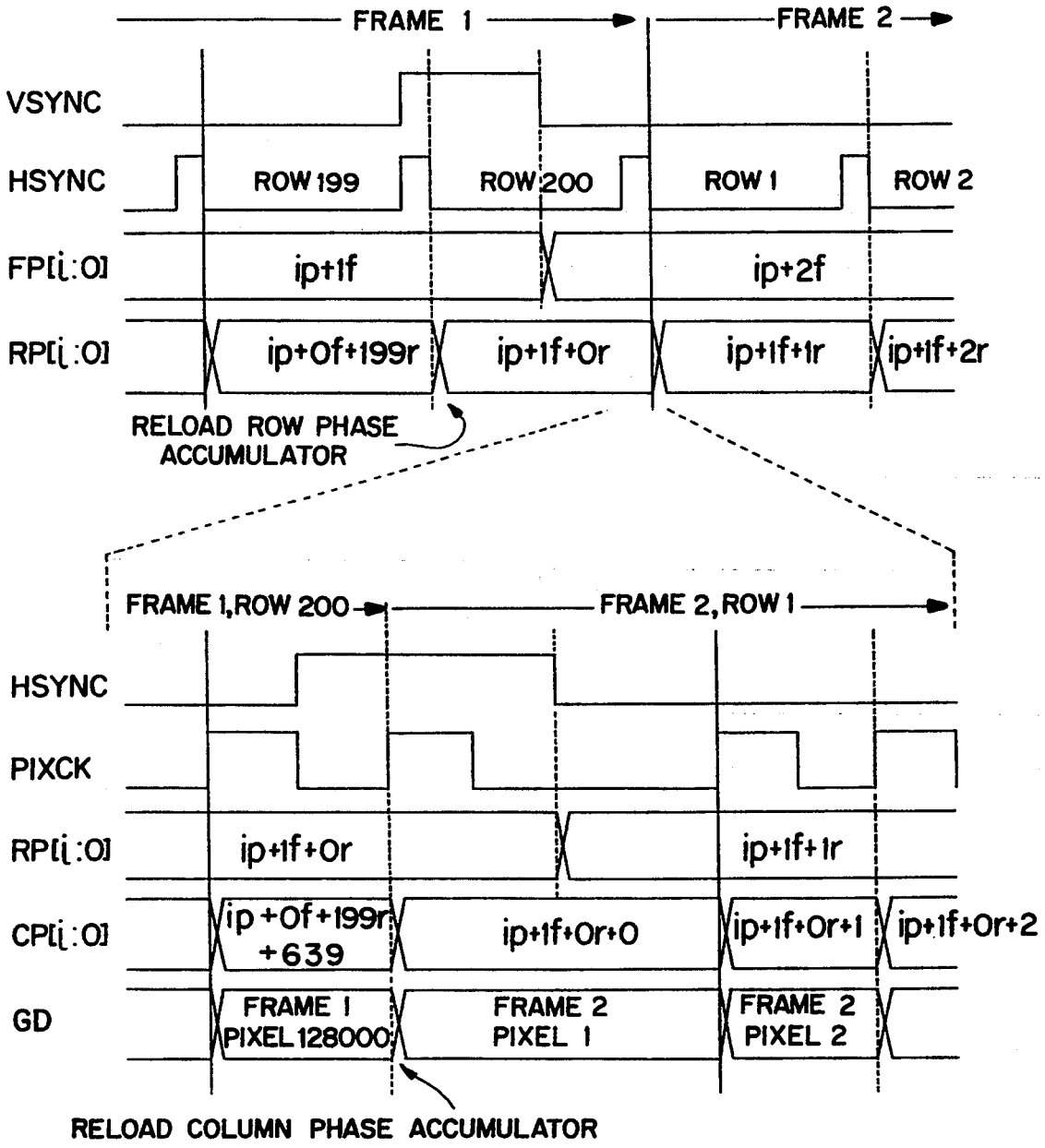
FIG. 3 is a timing diagram for the grey level generator of FIG. 2.

FIG. 3 shows the timing diagram for the grey level generator 2 of FIG. 2, and will be described in the following description of the operation of the invention.

Generating a grey level on a simple matrix liquid crystal display is achieved by lighting a given percentage of the available pixels in each frame. For example, lighting every fifth pixel along each row of pixels results in a displayed picture of approximately one fifth full brightness. (Liquid crystal displays exhibit a non-linear brightness response as the percentage of illuminated pixels is varied, so lighting every fifth pixel along each row will not necessarily produce a display of exactly one fifth full brightness.)

In order to avoid a completely static display, the pattern of illuminated pixels is moved from frame to frame. In the case of a 1/n duty cycle grey level (where 1 pixel in each series of n pixels along a row is illuminated in each frame), the pattern of illuminated pixels is moved in an n frame cycle such that each pixel in the pattern is illuminated in one frame out of every n frames.

To achieve a high quality grey level, the illuminated pixels must be positioned regularly in each frame and the pattern of illuminated pixels must change smoothly with time to inhibit striping and flickering effects. Thus, the phase relationship of the pattern of illuminated pixels in successive rows is adjusted for each grey level to spread the illuminated pixels evenly in each frame, and the phase relationship between the patterns of illuminated pixels in successive frames is adjusted to maximise as far as possible the spatial distance between illuminated pixels in successive frames.

Each column phase accumulator 10 is adapted to generate one or more repetitive grey level signals encoded in CP[i:0]. Each repetition of each grey level signal comprises a bit pattern indicative of whether each pixel of a series of n adjacent pixels in a row of the display should be illuminated when that row is displayed for the corresponding grey level. For an x/n duty cycle grey level, n represents the length (or number of pixels) in the repeating pattern of illuminated pixels, and x represents the number of illuminated pixels in the pattern x/n duty cycle levels, where $x > 1$, may be utilized to achieve better resolution of the grey levels, particularly around the 50% brightness level.

The output CP[i:0] is decoded by the decoder 16 as previously described and a single grey level signal GD appears as the output 3*a* of the generator 2 (NOT(GD) appearing on the corresponding output 3*b*). When a given grey level signal GD or NOT(GD) is applied, by the selector 4, as the input signal to the display, the n pixel pattern for the corresponding grey level is repeated along the first row of the display. When the data corresponding to the last pixel in the row is clocked in, the HSYNC signal is driven high to indicate that a new row is about to be addressed. If HSYNC is HIGH at the rising edge of PIXCK, the initial phase RP[i:0] of the repetitive grey level signal for the next row is then loaded into the column phase accumulator 10 from the row phase accumulator 12 and the phase adjusted grey level signal GD or NOT(GD) is then clocked into the second row of the display as before. In this way, the pattern of illuminated pixels in the second row is shifted by the row step relative to that for the first row. RP[i:0] is adjusted by the row step amount as HSYNC goes LOW. This process is repeated for all rows of the frame, such that the pattern of illuminated pixels between immediately successive rows is always shifted by the row step for the corresponding grey level.

As the last row of the first frame is displayed, VSYNC is driven high to indicate that a new frame is about to be addressed. If VSYNC is HIGH at the falling edge of HSYNC, the initial phase FP[i:0] of the grey level signal for the first row of the next frame is then loaded into the row phase accumulator 12 from the frame phase accumulator 14. Thus when HSYNC is driven HIGH at the end of the last row, the initial phase of the pattern for the start of the new frame is loaded from the row phase accumulator into the column phase accumulator 10 as before. In this way, the pattern of illuminated pixels in the first row of the next frame is shifted by the frame step relative to the last frame for a given grey level. FP[i:0] is adjusted by the frame step amount as VSYNC goes LOW. This sequence of events is then repeated for all successive frames so that the pattern of illuminated pixels between successive frames is always shifted by the frame step for the corresponding grey level.

| PHYSICAL COLOUR | DUTY CYCLE (x/n) | RELATIVE POSITION OF ACTIVE PIXELS (0 to n-l) | FRAME STEP(f) | ROW STEP | % LIT PIXELS | DIFFERENCE IN % LIT PIXELS BETWEEN SUCCESSIVE GREY LEVELS |
|---|---|---|---|---|---|---|
| 0 | 0 | | | | 0.0% | |
| 1 | 1/9 | 0 | +5 | +2 | 11.1% | 11.1% |
| 2 | 1/5 | 0 | +3 | +1 | 20.0% | 8.9% |
| 3 | 4/15 | 0, 2, 4, 6 | +8 | +3 | 26.7% | 6.7% |
| 4 | 3/9 | 0, 3, 6 | +5 | +2 | 33.3% | 6.6% |
| 5 | 2/5 | 0, 1 | +3 | +1 | 40.0% | 6.7% |
| 6 | 4/9 | 0, 1, 2, 3 | +5 | +2 | 44.4% | 5.4% |
| 7 | 1/2 | 0 | +1/+0 | +1 | 50.0% | 5.6% |
| 8 | 1/2 | | | | 50.0% | 0.0% |
| 9 | 5/9 | | | | 55.6% | 5.6% |
| 10 | 3/5 | | | | 60.0% | 5.4% |
| 11 | 6/9 | (PHYSICAL COLOURS 8 TO 15 ARE THE INVERSE OF PHYSICAL COLOURS 7 TO 0 RESPECTIVELY) | | | 66.7% | 6.7% |
| 12 | 11/15 | | | | 73.3% | 6.6% |
| 13 | 4/5 | | | | 80.0% | 6.7% |
| 14 | 8/9 | | | | 88.9% | 8.9% |
| 15 | 1 | | | | 100.0% | 11.1% |

FIG. 3 shows a timing diagram for the grey level generator of FIG. 2 configured to drive a liquid crystal display having 640 rows and 200 columns of pixels. In this figure, "f" represents the frame step, "r" the row step and "ip" the initial phase of a repetitive grey level signal at commencement i.e. for the first row of the first frame.

The timing diagram corresponds to the last two rows of a first frame and the first two rows of a second frame. The frame phase FP[i:0] is indicated in terms of the initial phase ip and the frame step f. The row phase RP[i:0] is indicated in terms of ip, f and the row step r. The output of the column phase accumulator CP[i:0] is indicated in terms of ip, f, r and the number of counts by which the column phase accumulator 10 has been incremented in each frame. The output GD of the decoder 16 indicates whether the current pixel addressed by the input signal should be illuminated or not.

As previously described, for each grey level, the phase relationship of the repeating patterns of illuminated pixels in successive frames is adjusted so as to maximise as far as possible the spatial distance between illuminated pixels in successive frames. In general, an x/n duty cycle grey level, this may be achieved by utilising a frame step f which is co-prime with n and as close as possible to n/2. For example, where n is odd, good results are achieved by utilising a frame step of (n+1)/2 or (n−1)/2. However, where n is even, in certain cases there may not be a value of the frame step f which is both co-prime with n and satisfactorily close to n/2. In these cases, better results may be achieved by utilising a frame step of alternately n/2 and (n+2)/2, or alternately n/2 and (n−2)/2. The alternating frame step ensures that all pixels are illuminated over n frames for the corresponding grey level. In the specific case of n=2, the frame step alternates between +1 and 0.

As previously described, the grey level generators 2 are adapted to generate, collectively, a range of grey levels having brightness intermediate 0% and 100%. The following grey-scale provides a well balanced set of 15 grey levels which have a high overall perceived quality.

Four grey levels generators 2 are used to produce 7 grey level signals corresponding to grey levels with duty cycles of ½, 1/5, 2/5, 1/9, 3/9, 4/9 and 4/15 as indicated above. Each of these grey level signals may be inverted to produce a total of 13 different grey levels (inverting a half duty cycle grey level produces an exactly equivalent grey level). Thus, including 0% brightness and 100%, a total of 15 different grey levels may be produced using only 4 grey level generators 2.

A 16 input selector 4 is controlled by the input data ID[3:0] and switches between the available grey levels to produce the output data OD which is applied as the input signal to the liquid crystal display in accordance with the following function table.

| ID[3:0] | OD |
|---|---|
| 0000 | '0' |
| 0001 | GD1/9 |
| 0010 | GD1/5 |
| 0011 | GD4/15 |
| 0100 | GD3/9 |
| 0101 | GD2/5 |
| 0110 | GD4/9 |
| 0111 | GD1/2 |
| 1000 | NOT(GD1/2) |
| 1001 | NOT(GD4/9) |
| 1010 | NOT(GD2/5) |
| 1011 | NOT(GD3/9) |
| 1100 | NOT(GD4/15) |
| 1101 | NOT(GD1/5) |
| 1110 | NOT(GD1/9) |
| 1111 | '1' |

The following function tables describe the operation of a grey level generator 2 for producing the ½ duty cycle grey level.

| Frame Phase Accumulator: (Frame step = +1/+0) | | |
|---|---|---|
| VSYNC | $FP2[1:0]_{(t)}$ | $FP2[1:0]_{(t+1)}$ |
| ↓ | 00 | 10 Count |
| ↓ | 10 | 01 |
| ↓ | 01 | 11 |
| ↓ | 11 | 00 |

-continued

| Row Phase Accumulator: (Row step = +1) | | | |
|---|---|---|---|
| VSYNC | HSYNC | $RP2[0]_{(t)}$ | $RP2[0]_{(t+1)}$ |
| 1 | ↓ | X | $FP2[0]_{(t)}$ Reload |
| 0 | ↓ | 0 | 1 Count |
| 0 | ↓ | 1 | 0 |
| **Column Phase Accumulator:** | | | |
| HSYNC | PIXCK | $CP2[0]_{(t)}$ | $CP2[0]_{(t+1)}$ |
| 1 | ↑ | X | $RP2[0]_{(t)}$ Reload |
| 0 | ↑ | 0 | 1 Count |
| 0 | ↑ | 1 | 0 |
| **Active Pixel Decoder** | | | |
| GD1/2 = CP2[0] | | | |

In the case of the ½ duty cycle grey level, alternate pixels along each row of the display are illuminated in each frame, and the pattern of illuminated pixels shifted by one pixel between immediately successive rows in each frame. However, the frame step must alternate between +1 and +0, i.e. the pattern of illuminated pixels is shifted by 1 pixel between corresponding rows of alternate frames only. This is necessary to avoid applying a single polarity drive voltage across the pixels, since, if the pattern of illuminated pixels were shifted by 1 pixel every frame, then pixels in even numbered columns of the display would only be illuminated with a positive voltage, being turned "off" in the following, negative biased frame, and similarly pixels in odd numbered columns would only be activated by a negative voltage. This would result in electrolysis of the liquid crystal.

The following function tables describe the operation of a grey level generator 2 for producing the 1/5 and 2/5 duty cycle grey levels.

| Frame Phase Accumulator: (Frame step = +3) | | | |
|---|---|---|---|
| RESET | VSYNC | $FP5[2:0]_{(t)}$ | $FP5[2:0]_{(t+1)}$ |
| 1 | ↓ | XXX | 000 Reset |
| 0 | ↓ | 000 | 010 Count |
| 0 | ↓ | 010 | 001 |
| 0 | ↓ | 001 | 100 |
| 0 | ↓ | 100 | 011 |
| 0 | ↓ | 011 | 000 |
| **Row Phase Accumulator: (Row step = +1)** | | | |
| VSYNC | HSYNC | $RP5[2:0]_{(t)}$ | $RP5[2:0]_{(t+1)}$ |
| 1 | ↓ | XXX | $FP5[2:0]_{(t)}$ Reload |
| 0 | ↓ | 000 | 001 Count |
| 0 | ↓ | 001 | 011 |
| 0 | ↓ | 011 | 010 |
| 0 | ↓ | 010 | 100 |
| 0 | ↓ | 100 | 000 |
| **Column Phase Accumulator:** | | | |
| HSYNC | PIXCK | $CP5[2:0]_{(t)}$ | $CP5[2:0]_{(t+1)}$ |
| 1 | ↑ | XXX | $RP5[2:0]_{(t)}$ Reload |
| 0 | ↑ | 000 | 001 Count |
| 0 | ↑ | 001 | 011 |
| 0 | ↑ | 011 | 010 |
| 0 | ↑ | 010 | 100 |
| 0 | ↑ | 100 | 000 |
| **Active Pixel Decoder** | | | |
| GD1/5 = CP5[2] | | | |
| GD2/5 = CP5[0] | | | |

The following function tables describe the operation of a grey level generator 2 for producing the 1/9, 3/9 and 4/9 duty cycle grey levels.

| Frame Phase Accumulator: (Frame step = +5) | | | |
|---|---|---|---|
| RESET | VSYNC | $FP9[3:0]_{(t)}$ | $FP9[3:0]_{(t+1)}$ |
| 1 | ↓ | XXXX | 0000 Reset |
| 0 | ↓ | 0000 | 1001 Count |
| 0 | ↓ | 1001 | 0001 |
| 0 | ↓ | 0001 | 1000 |
| 0 | ↓ | 1000 | 0010 |
| 0 | ↓ | 0010 | 1011 |
| 0 | ↓ | 1011 | 0100 |
| 0 | ↓ | 0100 | 1010 |
| 0 | ↓ | 1010 | 0101 |
| 0 | ↓ | 0101 | 0000 |
| **Row Phase Accumulator (Row step = +2)** | | | |
| VSYNC | HSYNC | $RP9[3:0]_{(t)}$ | $RP9[3:0]_{(t+1)}$ |
| 1 | ↓ | XXXX | $FP9[3:0]_{(t)}$ Reload |
| 0 | ↓ | 0000 | 0010 Count |
| 0 | ↓ | 0010 | 0101 |
| 0 | ↓ | 0101 | 1000 |
| 0 | ↓ | 1000 | 1010 |
| 0 | ↓ | 1010 | 0001 |
| 0 | ↓ | 0001 | 0100 |
| 0 | ↓ | 0100 | 1001 |
| 0 | ↓ | 1001 | 1011 |
| 0 | ↓ | 1011 | 0000 |
| **Column Phase Accumulator:** | | | |
| HYSNC | PIXCK | $CP9[3:0]_{(t)}$ | $CP9[3:0]_{(t+1)}$ |
| 1 | ↑ | XXXX | $RP9[3:0]_{(t)}$ Reload |
| 0 | ↑ | 0000 | 0001 Count |
| 0 | ↑ | 0001 | 0010 |
| 0 | ↑ | 0010 | 0100 |
| 0 | ↑ | 0100 | 0101 |
| 0 | ↑ | 0101 | 1001 |
| 0 | ↑ | 1001 | 1000 |
| 0 | ↑ | 1000 | 1011 |
| 0 | ↑ | 1011 | 1010 |
| 0 | ↑ | 1010 | 0000 |
| **Active Pixel Decoder** | | | |
| GD1/9 = CP9[1] AND CP9[0] | | | |
| GD3/9 = NOT (CP9[1]) AND NOT (CP9[0]) | | | |
| GD4/9 = CP9[3] | | | |

The following function tables describe the operation of a grey level generator 2 for producing the 4/15 duty cycle grey level.

| Frame Phase Accumlator: (Frame step = +8) | | | |
|---|---|---|---|
| RESET | VSYNC | $FP15[3:0]_{(t)}$ | $FP15[3:0]_{(t+1)}$ |
| 1 | ↓ | XXXX | 1111 Reset |
| 0 | ↓ | 1111 | 0111 Count |
| 0 | ↓ | 0111 | 1110 |
| 0 | ↓ | 1110 | 0110 |
| 0 | ↓ | 0110 | 1101 |
| 0 | ↓ | 1101 | 0101 |
| 0 | ↓ | 0101 | 1100 |
| 0 | ↓ | 1100 | 0100 |
| 0 | ↓ | 0100 | 1011 |
| 0 | ↓ | 1011 | 0011 |
| 0 | ↓ | 0011 | 1010 |
| 0 | ↓ | 1010 | 0010 |
| 0 | ↓ | 0010 | 1001 |
| 0 | ↓ | 1001 | 0001 |
| 0 | ↓ | 0001 | 1000 |
| 0 | ↓ | 1000 | 1111 |
| **Row Phase Accumulator: (Row step = +3)** | | | |
| VSYNC | HSYNC | $RP15[3:0]_{(t)}$ | $RP15[3:0]_{(t+1)}$ |
| 1 | v | XXXX | $FP15[3:0]_{(t)}$ Reload |
| 0 | v | 1111 | 1100 Count |
| 0 | v | 1100 | 1001 |
| 0 | v | 1001 | 0110 |
| 0 | v | 0110 | 0011 |
| 0 | v | 0011 | 1111 |
| 0 | v | 1110 | 1011 |

-continued

| | | | |
|---|---|---|---|
| 0 | v | 1011 | 1000 |
| 0 | v | 1000 | 0101 |
| 0 | v | 0101 | 0010 |
| 0 | v | 0010 | 1110 |
| 0 | v | 1101 | 1010 |
| 0 | v | 1010 | 0111 |
| 0 | v | 0111 | 0100 |
| 0 | v | 0100 | 0001 |
| 0 | v | 0001 | 1101 |

Columm Phase Accumulator:

| HSYNC | PIXCK | $CP15[3:0]_{(t)}$ | $CP15[3:0]_{(t+1)}$ |
|---|---|---|---|
| 1 | ↑ | XXXX | $RP15[3:0]_{(t)}$ Reload |
| 0 | ↑ | 1111 | 1110 Count |
| 0 | ↑ | 1110 | 1101 |
| 0 | ↑ | 1101 | 1100 |
| 0 | ↑ | 1100 | 1011 |
| 0 | ↑ | 1011 | 1010 |
| 0 | ↑ | 1010 | 1001 |
| 0 | ↑ | 1001 | 1000 |
| 0 | ↑ | 1000 | 0111 |
| 0 | ↑ | O111 | 0110 |
| 0 | ↑ | 0110 | 0101 |
| 0 | ↑ | 0101 | 0100 |
| 0 | ↑ | 0100 | 0011 |
| 0 | ↑ | 0011 | 0010 |
| 0 | ↑ | 0010 | 0001 |
| 0 | ↑ | 0001 | 1111 |

Active Pixel Decoder

It will be appreciated that the above described logic may be implemented in a number of different ways in accordance with the invention. In addition, it may be possible to control the number of PIXCK pulses generated for each row and frame so that the phase of the pattern of illuminated pixels for a given grey level is always correct at the start of each row and frame. In this case, the frame phase accumulator 14 and row phase accumulator 12 would not be required. Also, careful choice of the state numbers used in the accumulators 10, 12, and 14 may simplify or eliminate the active pixel decoder, and minimize the number of state bits used. It has also been found that grey levels of reasonable quality are achieved when the frame phase accumulator 14 and row phase accumulator 12 are transposed in each case. It will also be appreciated that illuminating a different corresponding plurality of pixels in successive rows of each frame is equivalent to illuminating a different corresponding plurality of pixels in successive columns of each frame, i.e. an equivalent grey level is achieved if the pattern of illuminated pixels for that grey level is transposed through 90°. For simplicity, the invention is described above with reference to the illumination in successive rows of a particular pattern of pixels for each grey level, the pattern being shifted by the row step between successive rows of each frame. It is to be understood, however, that "rows" and "columns" are interchangeable in this context and the specification should be construed accordingly.

Of course, many other variations and modifications may be made to the specific embodiment described above without departing from the scope of the invention as defined in the following claims.

I claim:

1. Apparatus for driving a one-bit-pixel raster scan video display device, having a display which comprises a plurality of rows each consisting of a plurality of pixels, to display a plurality of grey levels, which apparatus comprises means for generating an input signal for the display device to illuminate selected pixels thereby to indicate the desired grey level, the said means including:

means for generating a plurality of repetitive grey level signals, each having a respective repeat period equal to n number of bits wherein n is not the same number for each grey level, each grey level signal being indicative of a selected proportion of pixels to be illuminated to display the corresponding grey level;

selector means for selectively applying a said grey level signal as the input signal to the display device in dependence upon the desired grey level of the region of the display addressed; and signal adjustment means, adapted to introduce a row phase shift in each grey level signal, in response to an indication that a new row is to be addressed by the input signal, to cause illumination in successive rows of each frame of a different corresponding plurality of pixels for the same desired grey level, and adapted to introduce a variable frame phase shift of f bits into each grey level signal, in response to an indication that a new frame is to be addressed, to cause illumination in successive frames of a different corresponding plurality of pixels for the same desired grey level, wherein, when the repeat period equal to n for the respective grey level is odd, the frame phase shift f is co-prime and is as close as possible to n/2, and when the repeat period equal to n for the respective grey level is even, the frame phase shift f alternates between (n+2)/2 and n/2, or between n/2 and (n−2)/2).

2. Apparatus as claimed in claim 1 wherein the said means for generating a plurality of grey level signals comprises at least one column phase accumulator, and the signal adjustment means comprises at least one row phase accumulator, responsive to an indication that a new row is to be addressed, and at least one frame phase accumulator, responsive to an indication that a new frame is to be addressed.

3. Apparatus as claimed in claim 2 further comprising a decoder associated with the said at least one column phase accumulator for decoding an output from that column phase accumulator to produce at least one said grey level signal.

4. Apparatus as claimed in claim 3, wherein said decoder has at least a pair of output terminals, one output terminal of the pair being a non-inverting output for outputting a first signal and the other output terminal of the pair being an inverting output for outputting a second signal, wherein the second signal is the inverse of the first signal.

5. A method of driving a one-bit-per-pixel raster scan video display device, having a display comprising a plurality of rows each consisting of a plurality of pixels to display a plurality of grey levels, which method comprises:

generating an input signal for the display device to illuminate selected pixels thereby to indicate the desired grey level;

generating a plurality of repetitive grey level signals, each grey level signal being indicative of a selected proportion of pixels to be illuminated to display the corresponding grey level, and each said signal having a respective repeat period equal to n number of bits in length, the said n number of bits corresponding to n number of pixels of the said display device, wherein n is not the same number for each grey level;

selectively applying a said grey level signal as the input signal to the display device in dependence upon the desired grey level of the region of the display addressed, introducing a row phase shift in each grey level signal, in response to an indication that a new row is to be addressed by the input signal, to cause illumination in successive rows of each frame of a different corresponding plurality of pixels for the same desired grey level; and introducing a variable frame phase, shift of f bits into each grey level signal, in response to an indication that a new frame is to be addressed, to cause illumination in successive frames of a different corresponding plurality of pixels for the same desired grey level, wherein the frame phase shift f for each respective grey level is co-prime with the respective repeat period equal to n for the said respective grey level and f is also as close as possible to n/2, and when the repeat period equal to n for the respective grey level is even, the frame phase shift f alternates between first and second pre-determined amounts, wherein either the first and second pre-determined amounts are n/2 and (n+2)/2 or the first and second pre-determined amounts are n/2 and (n−2)/2.

6. A method as claimed in claim 5 wherein the frame phase shift alternates between first and second predetermined amounts, between corresponding rows of immediately successive frames.

7. A method as claimed in claim 6 wherein n is an even number greater than 2 for at least one of the said grey level signals, wherein the first predetermined amount is n/2 number of pixels and the second predetermined amount is (n+2)/2 or (n−2)/2 number of pixels.

8. A method as claimed in claim 6 wherein n is an odd number for at least one of the said grey level signals and wherein the frame phase shift for the said at least one grey level signal corresponds to (n+1)/2 or (n−1)/2 pixels.

9. A method as claimed in claim 8 wherein for n=5 the row phase shift corresponds to 1 pixel.

10. A method as claimed in claim 8 wherein for n=9 for the row phase shift corresponds to 2 pixels.

11. A method as claimed in claim 8 wherein for n=15 the row phase shift corresponds to 3 pixels.

12. A method as claimed in claim 5 wherein for each respective grey level with a repeat period corresponding to n number of pixels, each pixel is illuminated at least once every m frames, wherein m=n.

* * * * *